US006933497B2

(12) United States Patent
Vestal

(10) Patent No.: US 6,933,497 B2
(45) Date of Patent: Aug. 23, 2005

(54) TIME-OF-FLIGHT MASS ANALYZER WITH MULTIPLE FLIGHT PATHS

(75) Inventor: Marvin L. Vestal, Framingham, MA (US)

(73) Assignees: Per Septive Biosystems, Inc., Framingham, MA (US); MDS Inc., Concord (CA)

( * ) Notice: Subject to any disclaimer, the term of this patent is extended or adjusted under 35 U.S.C. 154(b) by 0 days.

(21) Appl. No.: 10/327,471

(22) Filed: Dec. 20, 2002

(65) Prior Publication Data

US 2004/0119012 A1 Jun. 24, 2004

(51) Int. Cl.[7] ..... H01J 49/40
(52) U.S. Cl. ..... 250/287; 250/281
(58) Field of Search ..... 250/287

(56) References Cited

U.S. PATENT DOCUMENTS 5,898,173 A 4/1999 Franzen
6,781,121 B1 * 8/2004 Davis et al. ..... 250/287
2002/0121594 A1 * 9/2002 Wang et al. ..... 250/281
2002/0175292 A1 * 11/2002 Whitehouse et al. ..... 250/394

* cited by examiner

*Primary Examiner*—John R. Lee
*Assistant Examiner*—Phillip Johnston
(74) *Attorney, Agent, or Firm*—Andrew T. Kamakis

(57) ABSTRACT

A TOF mass analyzer having multiple flight paths is described. The TOF mass analyzer includes a pulsed ion source that generates a packet of ions and that accelerates the packet of ions. An ion deflector directs a first group of ions from the packet of ions to a first ion path, and a second group of ions to a second ion path for each of a first and second predetermined time interval after the pulsed ion source generates the packet of ions. A first TOF mass separator separates the first group of ions according to their mass to-charge ratio and a first detector is positioned to receive the first group of ions A second TOF mass separator separates a second group of ions according to their mass to-charge ratio and a second detector is positioned to receive the second group of ions. Additional ion paths may be employed, and any type of TOF mass separator may be used in each ion path.

36 Claims, 6 Drawing Sheets

TIME-OF-FLIGHT MASS ANALYZER WITH MULTIPLE FLIGHT PATHS

BACKGROUND OF THE INVENTION

Mass analyzers vaporize and ionize a sample of interest and determine the mass-to-charge ratio of the resulting ions. Time-of-flight (TOF) mass analyzers determine the mass-to-charge ratio of an ion by measuring the amount of time it takes a given ion to migrate from an ion source to a detector, under the influence of electric fields. The time it takes for an ion to reach the detector, for an electric field of given field strength, is a direct function of the ion's mass and an inverse function of the ion's charge.

Recently, TOF mass analyzers have become widely used, particularly for the analysis of relatively nonvolatile biomolecules, and for other applications requiring high speed, high sensitivity, and/or wide mass range. New ionization techniques, such as matrix-assisted laser desorption/ionization (MALDI) and electrospray (ESI) have greatly extended the mass range of molecules that can be analyzed by mass analyzers. These techniques can produce intact molecular ions in a gas phase that are suitable for analysis.

TOF mass analyzers provide high resolution and precise mass measurement that can determine accurate data for the molecular weight of samples. For example, MALDI-TOF mass analyzers have been shown to have high resolution. MALDI-TOF mass analyzers are described in U.S. Pat. Nos. 5,625,184, 5,627,369, and 6,057,543. Orthogonal injection TOF mass analyzers with pulsed ion extraction have also been shown to have high resolution.

Time-of-flight mass analyzers can also determine structural information about samples by causing fragmentation and then measuring the mass of the fragments. Some MALDI-TOF mass analyzers use a technique known as post-source decay (PSD) to fragment the ions. Other MALDI-TOF mass analyzers include a collision cell that causes some of the ions to undergo high energy collisions with neutral gas molecules to enhance the production of low mass fragment ions and to produce some additional fragmentation. Still other mass analyzers use ESI-TOF that produce fragmentation by causing energetic collisions to occur in the interface between the atmospheric pressure electrospray and the evacuated mass analyzer.

Tandem mass analyzers, which are generally referred to as MS-MS instruments, use multiple mass analyzers in series to determine structural information about samples. MS-MS instruments are typically used for peptide sequencing. MS-MS instruments use mass analyzer techniques to select a primary ion, to fragment the primary ion, and then to detect and analyze the fragment ions, thereby producing a mass spectrum of the fragment ions from the selected primary ion.

One type of tandem mass analyzer includes two quadrupole mass filters and a TOF mass analyzer. The first quadrupole mass filter selects the primary ion. The second quadrupole mass filter is maintained at a sufficiently high pressure and voltage so that multiple low energy collisions occur to produce fragments of the selected primary ions. The TOF mass analyzer detects and analyzes the fragment ion spectrum.

There are several types of TOF mass analyzers known in the art. These include a linear analyzer comprising a pulsed ion source, a field-free, evacuated drift space, and a detector. Another type of TOF mass analyzer further comprises an ion reflector interposed in the field-free drift space to minimize the dependence of the ion flight time on the kinetic energy.

Still another type of mass analyzer, described in U.S. Pat. No. 6,348,688 includes additional elements, such as an ion accelerator, an ion fragmentor, and a timed ion selector to provide a tandem TOF mass analyzer wherein a primary ion of interest, for example, a molecular ion of a particular sample, is selected and the ion of interest is then fragmented by increasing the ion's internal energy. The mass spectrum of the ion fragment is then analyzed by a second TOF mass analyzer. The structure of the primary ion is determined by interpreting its fragmentation pattern. In the prior art one or more of these analyzers may be incorporated into a single instrument, but the different analyzers cannot be operated simultaneously. The term "simultaneously" is defined herein to mean that multiple analyzers are operating on a each individual pulse of ions from the pulsed ion source.

In prior art TOF mass analyzers multiple types of mass analyzers may be arranged so that ions may be analyzed by more than one analyzer. A TOF mass analyzer according to the prior art includes a pulsed ion source that generates a packet of ions and that accelerates the packet of ions. A portion of the packet of ions, corresponding to a predetermined mass range, is directed along a flight path that may include one or more mass analyzers. In one prior art spectrometer, a linear TOF mass analyzer, a reflector TOF mass analyzer, and a tandem TOF MS-MS mass analyzer share a common flight path. The analyzer to be employed for a particular measurement is selected by applying appropriate voltages to elements of the mass analyzers. Only one mass analyzer may be selected for a particular measurement. Ions outside the predetermined mass range are rejected by an ion deflector before the ions enter the common flight path of the analyzers. A number of packets of ions are separated, analyzed, and summed in a digitizer to produce a mass spectrum. The operating conditions for the mass analyzer are optimized for recording ions in a predetermined mass range, and any ions produced by the ion source that fall outside this predetermined mass range are discarded. A different mass analyzer, mass range, and operating mode may be chosen for a subsequent analysis, and again any ions falling outside the predetermined mass range are discarded. This sequential acquisition of multiple mass spectra employing multiple mass analyzers, operating conditions, and mass ranges is wasteful of both sample and time. Thus it is apparent that the need exists for an improved TOF mass analyzer capable of carrying out multiple modes of operation simultaneously in time.

SUMMARY OF THE INVENTION

The present invention relates to a TOF mass analyzer having multiple flight paths. The TOF mass analyzer of the present invention has multiple modes of operation that can be performed simultaneously in time. The TOF mass analyzer of the present invention is more efficient and less expensive to manufacture compared with known mass analyzers with similar capabilities. For example, one digitizer can be used to simultaneously record data for two independent mass separators.

In the present invention multiple mass analyzers, mass ranges, and operating conditions can be employed for each individual packet of ions produced by the ion source. These results can be summed in a single digitizer so that multiple mass spectra are acquired simultaneously. This allows more efficient use of the sample, and reduces the total time required for the measurements.

A TOF mass analyzer according to the present invention includes a pulsed ion source that generates a packet of ions and that accelerates the packet of ions. In one embodiment, the pulsed ion source is a laser desorption/ionization ion source. In another embodiment, the pulsed ion source is a delayed extraction ion source. In yet another embodiment, the pulsed ion source is an injector that injects ions into a first field-free region and a pulsed ion accelerator that extracts the ions in a direction that is orthogonal to a direction of injection.

A TOF mass analyzer according to the present invention includes an ion deflector that directs ions selected from the packet of ions along either a first ion path or along a second or third ion path. In some embodiments, even more ion paths may be employed. A time-dependent voltage is applied to the deflector to select among the available ion paths and to allow ions having a mass-to-charge ratio within a predetermined mass-to-charge ratio range to propagate along a selected ion path. In one embodiment, the invention includes a field-free drift space interposed between the pulsed ion source and the ion deflector.

A first predetermined voltage is applied to the deflector for a first predetermined time interval that corresponds to a first predetermined mass-to-charge ratio range, thereby causing ions within first mass-to-charge ratio range to propagate along the first ion path. In one embodiment, this first predetermined voltage is zero allowing the ions to continue to propagate along the initial path.

A second predetermined voltage is applied to the deflector for a second predetermined time range corresponding to a second predetermined mass-to-charge ratio range thereby causing ions within the second mass-to-charge ratio range to propagate along the second ion path. Additional time ranges and voltages including a third, fourth etc. can be employed to accommodate as many ion paths as are required for a particular measurement. The amplitude and polarity of the first predetermined voltage is chosen to deflect ions into the first ion path, and the amplitude and polarity of the second predetermined voltage is chosen to deflect ions into the second ion path. The first time interval is chosen to correspond to the time during which ions within the first predetermined mass-to-charge ratio range are propagating through the deflector and the second time interval is chosen to correspond to the time during which ions within the second predetermined mass-to-charge ratio range are propagating through the deflector.

A first TOF mass separator is positioned to receive the packet of ions within the first mass-to-charge ratio range propagating along the first ion path. The first TOF mass separator separates ions within the first mass-to-charge ratio range according to their masses. A first detector is positioned to receive the first group of ions that are propagating along the first ion path. A second TOF mass separator is positioned to receive the portion of the packet of ions propagating along the second ion path.

The second TOF mass separator separates ions within the second mass-to-charge ratio range according to their masses. A second detector is positioned to receive the second group of ions that are propagating along the second ion path. In some embodiments, additional mass separators and detectors including a third, fourth, etc. may be positioned to receive ions directed along the corresponding path. In one embodiment, a third ion path is employed that discards ions within the third predetermined mass range.

The term "mass separator" is defined herein to mean a region in a TOF mass analyzer that is positioned after an ion source that produces the ions to be analyzed and before an ion detection device. The first and second mass separators can be any type of mass separator. For example, at least one of the first and the second mass separator can include a field-free drift region, an ion accelerator, an ion fragmentor, or a timed ion selector. The first and second mass separators can also include multiple mass separation devices.

In one embodiment, the TOF mass analyzer includes an ion reflector that is positioned to receive the first group of ions, whereby the ion reflector improves the resolving power of the TOF mass analyzer for the first group of ions. In one embodiment, the TOF mass analyzer includes an ion reflector that is positioned to receive the second group of ions, whereby the ion reflector improves the resolving power of the TOF mass analyzer for the second group of ions.

In one embodiment, the TOF mass analyzer includes a first and a second data analyzer that are electrically connected to the first and the second detectors, respectively. In another embodiment, the TOF mass analyzer includes a single data analyzer that is electrically connected to both the first and the second detectors.

In one embodiment, a processor generates a time varying voltage that is applied to the ion deflector to deflect a first portion of the packet of ions to the first ion path for a first predetermined time interval and a second portion of the packet of to the second ion path for a second predetermined time after the pulsed ion source generates the packet of ions. The processor can instruct a data analyzer to record electrical signals generated by at least one of the first and the second detectors to determine the mass-to-charge ratio of ions generated by the pulsed ion source. The electrical signals can be generated by a single pulse or from multiple pulses of the same sample that are summed to produce an average mass spectrum.

A method for TOF mass spectrometry according to the present invention includes generating and accelerating a packet of ions from a sample of interest. The packet of ions may be a single pulse of ions. In one embodiment, the packet of ions is generated by performing laser desorption/ionization. In another embodiment, the packet of ions is generated by injecting ions into a field-free region and then accelerating the ions in a direction that is orthogonal to a direction of injection.

Ions from the packet of ions with mass-to-charge ratios within a first predetermined mass range are directed to a first TOF mass separator wherein they are separated according to their mass-to-charge ratios and detected. Ions from the packet of ions with mass-to-charge ratios within a second predetermined mass range are directed to a second TOF mass separator wherein they are separated according to their mass-to-charge ratios and detected. Ions within the first and second mass ranges can be separated by any means. For example, at least one of the first and the second mass ranges can be separated by drifting the ions through a field-free drift space.

The first and second mass ranges can be detected by any means. In one embodiment, the time interval for detecting the first mass range of ions does not overlap the time interval for detecting the second group of ions. In one embodiment, the method is performed so that the first group of ions comprises relatively low mass ions and the second group of ions comprises relatively high mass ions.

A method of performing TOF mass spectrometry on one packet of ions according to the present invention includes generating and accelerating a packet of ions from a sample of interest. The packet of ions may be a single pulse of ions. A portion of the packet of ions is deflected at a predetermined time after generating the packet of ions. A first group of ions is separated from a portion of the packet of ions and then detected. A second group of ions is separated from the portion of the packet of ions. A portion of the second group of ions is then fragmented. The second group of ions and fragments thereof are then detected. In one embodiment, the time interval for detecting the first group of ions does not overlap with the time interval for detecting the second group of ions and fragments thereof.

BRIEF DESCRIPTION OF THE DRAWINGS

This invention is described with particularity in the appended claims. The above and further aspects of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

Figure 1:
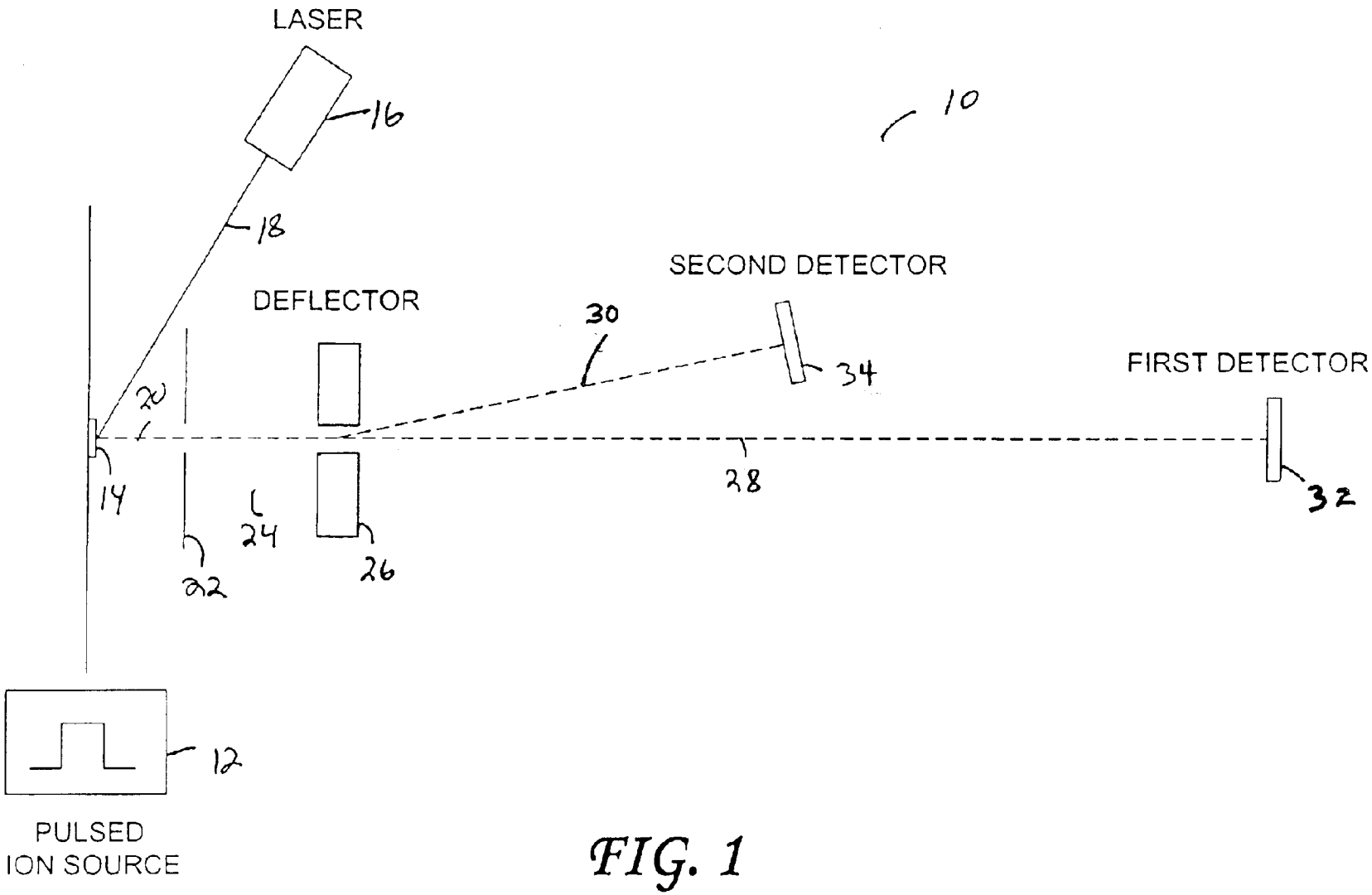
FIG. 1 illustrates a schematic diagram of an embodiment of a TOF linear mass analyzer having multiple flight paths according to the present invention.

FIG. 1 illustrates a schematic diagram of an embodiment of a linear TOF mass analyzer 10 having multiple flight paths according to the present invention. The term "linear TOF mass analyzer" is defined herein to mean a mass analyzer where the ion path is in one direction along a substantially co-linear path. In other embodiments, a TOF mass analyzer according to the present invention can have a non-linear ion path. The term "non-linear flight path" is defined herein to mean a flight path that changes direction. For example, a TOF mass analyzer of the present invention can include an ion reflector (which is also called a reflectron or an ion mirror) along the ion path that changes the direction of the ions with one or more retarding electrostatic fields.

Some known TOF mass analyzers have multiple flight paths. For example, published PCT Application No. WO 00/77823 A2, which is assigned to the assignee of the present application, includes a lens and steering plate that is adapted to focus the ion beam spatially into different flight paths. The lens and steering plate are used to defocus the ion beam so that a portion of the ion beam strikes an annular detector that is positioned in front of the timed ion selector to acquire spectra of the primary ions. After the spectrum of primary ions is acquired, the lens and steering plate focuses the ion beam spatially onto the entrance of a CID cell to select and analyze the ions of interest. However, this known TOF mass analyzer and other known TOF mass analyzers are not capable of achieving multiple modes of operation during a single pulse of ions as described herein in connection with the present invention.

The linear TOF mass analyzer 10 includes a pulsed ion source 12 that generates a packet of ions from a sample 14. The term "packet of ions" is defined herein to mean a group of ions that are generated by a single electrical pulse in a pulsed ion source. The sample 14 can be any sample from which the pulsed ion source 12 can generate the packet of ions. For example, the sample 14 can be a biological sample that includes a mixture of peptides produced by enzymatic digestion of proteins. The sample can also be an inorganic or organic chemical sample, or a mixture of organic and inorganic compounds.

In one embodiment, the pulsed ion source 12 is a delayed extraction ion source that extracts the ions after a predetermined time delay following an ionization event. For example, in one embodiment, the pulsed ion source 12 is a delayed extraction laser desorption/ionization ion source (not shown). In this embodiment, a pulsed laser 16 is used to irradiate the sample 14 to be ionized with a pulsed laser beam 18. The laser beam 18 generates a packet of ions during the laser pulse.

In another embodiment, the pulsed ion source 12 includes an ion injector (not shown) that injects ions into a first field-free region, and a pulsed ion accelerator (not shown) that extracts a packet of ions from the injected ions by accelerating the ions in a direction that is orthogonal to the direction of injection. In other embodiments (not shown), the pulsed ion source 12 is a pneumatically-assisted electrospray, chemical ionization, or ICP ion source.

The generated packet of ions is accelerated by applying a potential to at least one of the sample 14 and the extraction grid 22 at a predetermined time after ionization. An ion deflector 26 is positioned along the path 20 of the accelerated ions to receive the accelerated packet of ions. In one embodiment a field-free drift space 24 is interposed between the extraction grid 22 and the ion deflector 26.

The ion deflector 26 directs a first portion of the packet of ions along the first ion path 28 during a first predetermined time interval after ionization and a second portion of the packet of ions to a second ion path 30 during a second predetermined time interval after ionization. Any type of ion deflector can be used. In one embodiment, a pair of electrodes is positioned substantially parallel to the direction of initial propagation. The ion beam passes between the electrodes and a potential difference between the electrodes causes the ion beam to be deflected.

The magnitude of the deflection is controlled by varying parameters, such as, the magnitude of the potential difference relative to the kinetic energy of the ions, the spacing between the electrodes and the length of the deflecting field in the direction of initial propagation. The direction of the deflection is determined by the polarity of the applied potenitial difference. In some embodiments of the mass analyzer of the present invention, the ion deflector is used to direct the generated packet of ions to two or more different ion paths (not shown). In the embodiment illustrated in FIG. 1 the voltage applied to the deflector 26 is zero during the first predetermined time interval so that the first ion path 28 coincides with the accelerated ion path 20. The first and second ion paths 28, 30 are enclosed in evacuated, field-free drift spaces that separate the ions in the packet of ions in time according to their mass-to-charge ratios. A first detector 32 is positioned at the end of the first ion path 28 to receive ions in the ion packet that have propagated in the first ion path 28. A second detector 34 is positioned at the end of the second ion path 30 to receive ions in the ion packet that have propagated in the second ion path 30.

The first predetermined time interval is chosen to correspond to the time interval during which a first predetermined mass range arrives at the deflector 26, and the second predetermined time interval is chosen to correspond to the time interval during which a second predetermined mass range arrives at deflector 26. The operating conditions applied to the pulsed ion source may be adjusted so that ions substantially within the first mass range are focused in time at the first ion detector 32, and ions substantially within the second mass range are focused in time at the second ion detector 34. The gain and other operating conditions for the detectors 32 and 34 may be independently optimized for the first and second mass ranges, respectively.

Acquiring mass spectra for two or more mass ranges simultaneously allows the operator to more quickly and efficiently detect different types of ions and, therefore, reduces the time it takes to analyze a sample or samples of interest.

Figure 2:
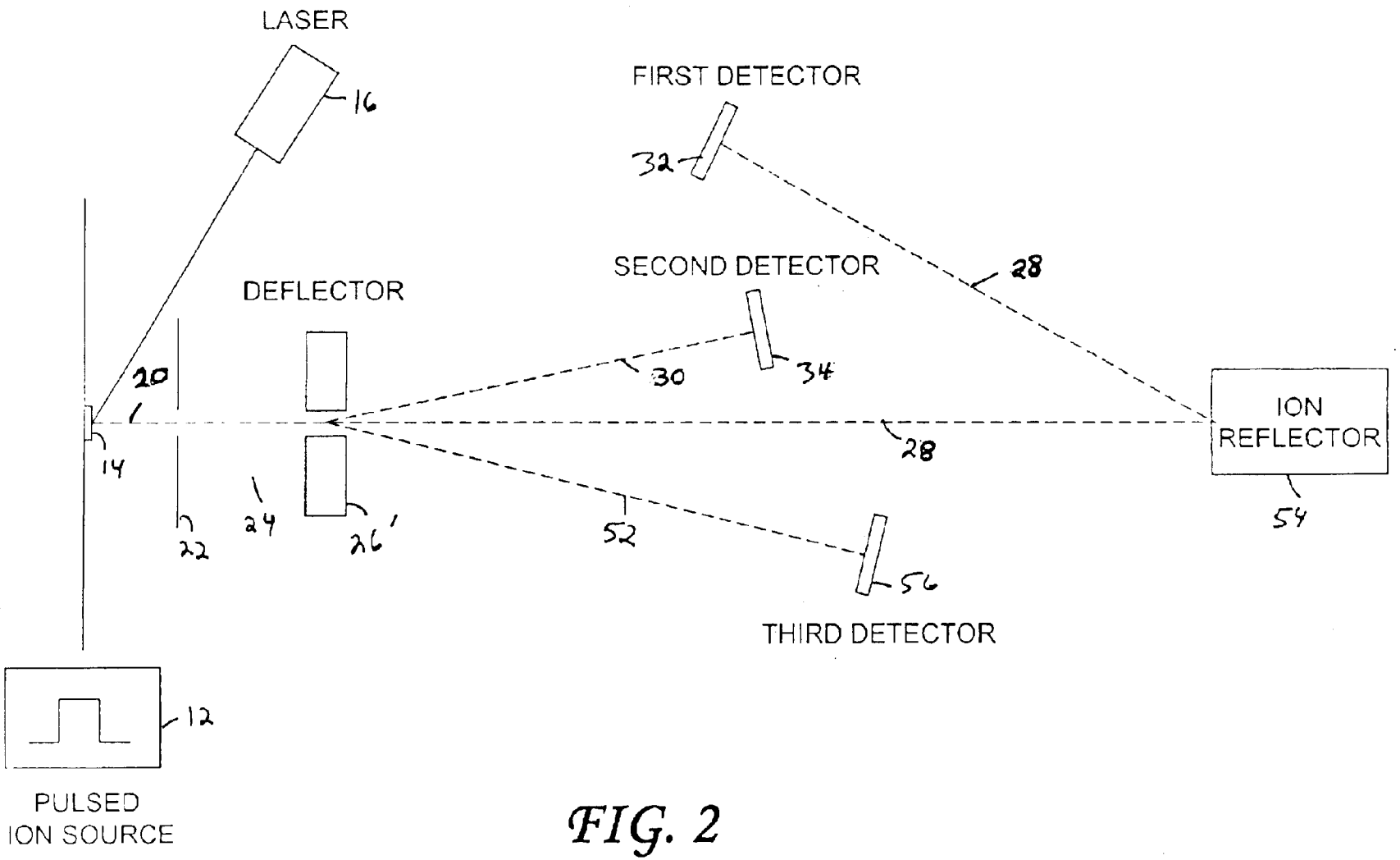
FIG. 2 illustrates a schematic diagram of an embodiment of a TOF mass analyzer having three flight paths according to the present invention and having an ion mirror in one flight path.

FIG. 2 illustrates a schematic diagram of an embodiment of a TOF mass analyzer 50 having three flight paths according to the present invention and having an ion mirror in one flight path. The TOF mass analyzer 50 includes a pulsed ion source 12 that generates a packet of ions from a sample 14 as described in connection with FIG. 1. In one embodiment, the pulsed ion source 12 is a delayed extraction ion source that extracts the ions after a predetermined time delay following an ionization event.

The generated packet of ions is accelerated by applying a potential to at least one of the sample 14 and the extraction grid 22 at a predetermined time after ionization. An ion deflector 26' is positioned along the path 20 of the accelerated ions to receive the accelerated packet of ions. In one embodiment a field-free drift space 24 is interposed between the extraction grid 22 and the ion deflector 26'.

The ion deflector 26' directs a first portion of the packet of ions propagating along the path 20 to a first ion path 28 during a first predetermined time interval after ionization. The ion deflector 26' also directs a second portion of the packet of ions propagating along the ion path 20 to a second ion path 30 during a second predetermined time interval, and directs a third portion of the packet of ions propagating along the ion path 20 to a third ion path 52 during a third predetermined time interval. Any type of ion deflector can be used as described in connection with FIG. 1.

In the embodiment illustrated in FIG. 2 the voltage applied to the deflector 26' is zero during the first predetermined time interval so that the first ion path 28 coincides with the accelerated ion path 20. The first portion of the packet of ions is propagated along the first ion path 28 to an ion reflector 54. The ion reflector 54 reflects the packet of ions to the first detector 32. Ions deflected into second path 30 are detected by second detector 34, and ions deflected into third path 52 are detected by third detector 56. In one embodiment, the TOF mass analyzer 50 does not include a third detector 56 and ions deflected into the third ion path 52 are discarded. In one embodiment, the first 32, second, 34, and third detector 56 are electrically coupled to a single digitizer (not shown) so that spectra from all three detectors are recorded simultaneously by one digitizer.

There are numerous physical embodiments of the TOF mass analyzer 50 according to the present invention. The actual geometry of the analyzer 50 depends upon many design parameters and the particular applications and measurements desired. For purposes of illustrating the present invention, the following example is described. In this example, the effective distance between the sample 14 and the ion deflector 26' is approximately 4 cm, the effective distance to the second detector 34 is approximately 20 cm, and the effective distance to first detector 32 in the reflecting analyzer is approximately 200 cm. In this example "effective distance" is equal to the physical distance for a field-free region and for regions comprising electrical fields is defined to be the distance that an ion must travel in a field-free region for the flight time to be equal to the flight time through the region comprising electrical fields. For example, if an ion is accelerated from rest in a uniform electrical field, the "effective distance" is twice the length of the field.

In this example, the pulsed ion source 12 is a delayed extraction MALDI source that is adjusted so that mass 20,000 is time focused at the second detector 34. The focal length is approximately proportional to the square root of the mass-to-charge ratio. In this embodiment, mass 2000 will be focused at approximately 6.3 cm. The voltage applied to the ion reflector 54 is adjusted so that mass 2000 is refocused at the first detector 32. In this embodiment, an ion having m/z equal to 500 Daltons reaches the ion deflector 26' at approximately 0.5 microseconds after the ion source 12 is pulsed, an ion having m/z equal to mass 3000 Daltons reaches the ion deflector 26' at approximately 1.22 microseconds, and an ion having m/z equal to 50,000 Daltons reaches the ion deflector 26' at approximately 5 microseconds.

At time zero, a voltage is applied to the ion deflector 26' that causes ions in the ion deflector 26' to be directed toward the third ion path 52 where these ions are discarded. After approximately 0.5 microseconds, the voltage applied to the ion deflector 26' is turned off, which passes ions in the m/z range of 500–3000 to the ion reflector 54 and then to the first detector 32. After 1.22 microseconds, a second voltage is applied to the ion deflector 26' that causes ions in the ion deflector 26', which have m/z greater than 3000, to be directed towards the second ion path 30 to second detector 34. After 5 microseconds, a voltage is applied to the ion deflector 26' which directs any ions having m/z higher than approximately 50,000 to the third flight path 52 where these ions are discarded.

Thus, in this example, ions in the m/z range between 0 and 500 and greater than 50,000 are discarded. Ions with m/z in the range 3000–50,000 arrive at the second detector 34 within the time range between approximately 6.1 and 24.9 microseconds, and ions in the m/z range between 500 and 3000 arrive at the first detector 32 within the time range between 25 and 61.2 microseconds. Since these time ranges do not overlap, a single digitizer can be used to record both spectra. Both spectra are recorded for each pulse of ions from the ion source, and spectra from a number of pulses can be added by the digitizer to simultaneously record averaged spectra for both mass ranges. The detector gain and the bin width of the portion of digitizer used for each mass range can be independently optimized.

In this example, the effective distance between the pulsed ion source 12 and the ion deflector 26' is short relative to the effective distances from the ion deflector 26' to the first 32, second 34, and third detector 56. Also, the physical length of the ion deflector 26' is short relative to the effective distance between the pulsed ion source 12 and the ion deflector 26'.

In one embodiment, the physical length of the ion deflector 26' is less than 10% of the effective distance between the pulsed ion source 12 and the closest detector. Therefore, the number of ions within the ion deflector 26' at the time that the voltage applied to the ion deflector 26' is switched from one value to another is minimized. Minimizing the number of ions within the ion deflector 26' during switching minimizes the number of undetected ions that are partially deflected and travel between two beam paths and, therefore, increases the accuracy and sensitivity of the measurement.

There are many applications for the TOF mass analyzer 50. In one embodiment, the TOF mass analyzer 50 performs simultaneous measurements of low molecular weight peptides and higher molecular weight peptides and proteins. The low molecular weight peptides are measured with high resolution in the first ion path 28 using the ion reflector 54 and the first detector 32. The higher molecular weight peptides and proteins are measured with lower resolution, but higher sensitivity in the second ion path 30 using the second detector 34. In this embodiment, the third detector 56 is not required and ions deflected into the third ion path 52 are discarded.

Figure 3:
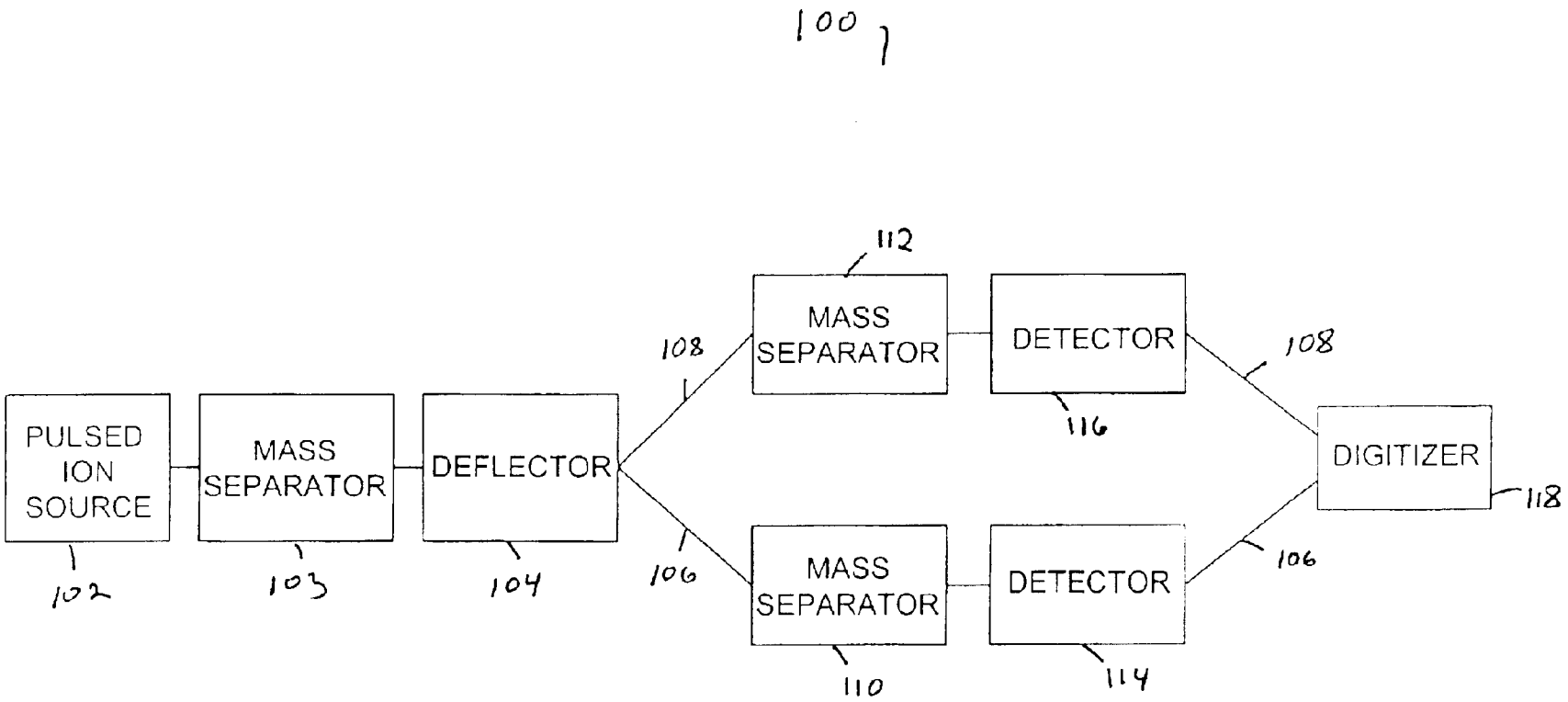
FIG. 3 illustrates a block diagram of an embodiment of a TOF mass analyzer according to the present invention having a first mass separator in one ion path and a second mass separator in another ion path.

FIG. 3 illustrates a block diagram of an embodiment of a TOF mass analyzer 100 according to the present invention having a first mass separator in one ion path and a second mass separator in another ion path. The mass analyzer 100 includes a pulsed ion source 102 that generates and accelerates a packet of ions as described herein. The accelerated packet of ions then propagates through a mass separator 103 as described herein. An ion deflector 104 deflects the generated packet of ions into a first ion path 106 and a second ion path 108 for predetermined time intervals after ionization. The ion deflector 104 can be any type of ion deflector.

A first mass separator 110 is positioned in the first ion path 106 and a second mass separator 112 is positioned in the second ion path 108. The mass separators 110, 112 can be any type of TOF mass separators as described herein. A first detector 114 is positioned after the first mass separator 110 in the first ion path 106. A second detector 116 is positioned after the second mass separator 112 in the second ion path 108.

The first and second detectors 114, 116 generate electrical pulses at outputs when ions in the packet of ions strike surfaces of the detectors 114, 116. The gain of the first detector 114 can be adjusted independently of the gain of the second detector 116 in order to optimize the detection of particular portions of a mass spectrum. Also, adjusting the gain of the first detector 114 independent of the gain of the second detector 116 can be used to reduce or eliminate detector saturation.

The first and second detectors 114, 116 have outputs that are electrically connected to a data analyzer or digitizer 118. In one embodiment, the digitizer 118 is an integrating transient digitizer. The digitizer 118 records the electrical pulses produced by the first and second detectors 114, 116 as a function of time. The time interval between the generation of the packet of ions and the recordation of the electrical pulses produced by the first and second detectors 114, 116 in response to the detected ions is calibrated to provide a measurement of the mass-to-charge ratio of the detected ions.

The digitizer 118 collects data for ions separated by the first and the second mass separators 110, 112 substantially simultaneously in time. Using one digitizer to record data for two independent mass separators reduces the total cost of the TOF mass analyzer 100 compared with known TOF mass analyzers having comparable capabilities.

In another embodiment, which is described in connection with FIG. 5, the TOF mass analyzer 100 includes a first and a second data analyzer or digitizer that separately collects data for ions separated by the first and the second mass separator 110, 112. Including two digitizers significantly increases the cost of the TOF mass analyzer. However, in applications where the time ranges for detecting ions by two detectors or more detectors overlap, it may be necessary to use two or more digitizers to unambiguously determine the mass spectra.

Including two digitizers allows the operator to select a digitizer for each mass separator that has properties which are suitable for the particular spectrum that will be digitized. For example, in one embodiment, the first mass separator 110 is used to separate the low mass portion of the mass spectrum and the second mass separator 112 is used to separate the high mass portion of the mass spectrum.

In this embodiment, a first digitizer is connected to the first detector 114 that is selected to have a relatively small bin width because time resolution is particularly important for the first digitizer. A second digitizer is connected to the second detector 116 that has a relatively large bin width because time resolution is less important for the second digitizer and it is advantageous to reduce the total number of bins required to record the mass spectrum.

In one embodiment, the TOF mass analyzer 100 includes an ion counting time-digital converter (TDC) (not shown) that records a weaker portion of the mass spectrum from data acquired from one of the first and the second detectors 114, 116 when less than one ion count/bin per individual record is expected. In this embodiment an integrating transient digitizer may record a stronger portion of the spectrum detected by the other detector.

In one embodiment, the spectrum recorded on one of the first and the second detectors 114, 116 is used to internally calibrate the mass spectrum recorded on the other of the first and the second detector 114, 116. The relative mass scales for spectra recorded on the first and the second detectors 114, 116 depends on the distance from the pulsed ion source 102 to the first detector 114 relative to the distance from the pulsed ion source 102 to the second detector 116. The relative distance can be determined precisely by recording spectra for known masses on both the first and the second detectors 114, 116.

In this embodiment, the TOF mass analyzer 100 may need to be calibrated for variations in flight times that can occur as the result of various parameters, such as changes in the accelerating voltage, the time delay between forming the packet of ions and the initiation of the flight time measurement, and changes in the physical distance from the pulsed ion source 102 to the first and the second detectors 114, 116. For example, the physical distances from the pulsed ion source 102 to the first and the second detectors 114, 116 can change as a result of thermal expansion within the TOF mass analyzer 100. In one embodiment, the TOF mass analyzer 100 is designed to reduce the effect of thermal expansion. In this embodiment, the first and the second detectors 114, 116 are mounted so that they both experience the same thermal expansion.

In some embodiments, the TOF mass analyzer 100 includes a processor (not shown) that controls at least one of the pulsed ion source 102, the mass separator 103, the pulsed ion deflector 104, the first and second mass separators 110, 112, and the digitizer 118. One aspect of the TOF mass analyzer 100 of the present invention is that different modes of operation can be selected electrically. The processor can be used to select the mode of operation. The processor can also be used to process data from the digitizer 118 to determine the mass-to-charge ratio of the detected ions and fragments thereof.

A method of operating the TOF mass analyzer 100 in the linear MS mode to analyze two groups of ions includes generating a packet of ions with the pulsed ion source 102 and accelerating the packet of ions towards the pulsed ion deflector 104. The pulsed ion deflector 104 deflects the generated packet of ions into a first ion path 106 and a second ion path 108 at a predetermined time after ionization.

The first and the second TOF mass separators 110, 112 select a first and a second group of ions, respectively. The first detector 114 detects as a function of time the first group of ions. The second detector 116 detects as a function of time the second group of ions and fragments thereof. The linear MS mode of operating the TOF mass analyzer 100 can provide relatively high mass sensitivity in two mass ranges. The gain of the first detector 114 and the gain of the second detector 116 can be independently adjusted to optimize the detection of the masses in the two mass ranges.

For example, in one embodiment, the TOF mass analyzer 100 separates low mass ions in one of the first and the second mass separators 110, 112 and separates high mass ions in the other of the first and the second mass separators 110, 112. The focal plane for the low mass ions is closer to the pulse ion generator 102 than the focal plane for the high mass ions for a given extraction pulse delay.

Also, the intensity of the low-mass portion of the spectrum is often much more intense than the intensity of the high mass portion of the spectrum. Thus, in this embodiment, the gain of the detector that detects the low mass ions is chosen to be lower than the gain of the detector that detects the high-mass ions. Appropriately adjusting the gain of the low and high mass detectors results in high mass sensitivity for both the low mass and the high mass ions and also eliminates detector saturation.

Figure 4:
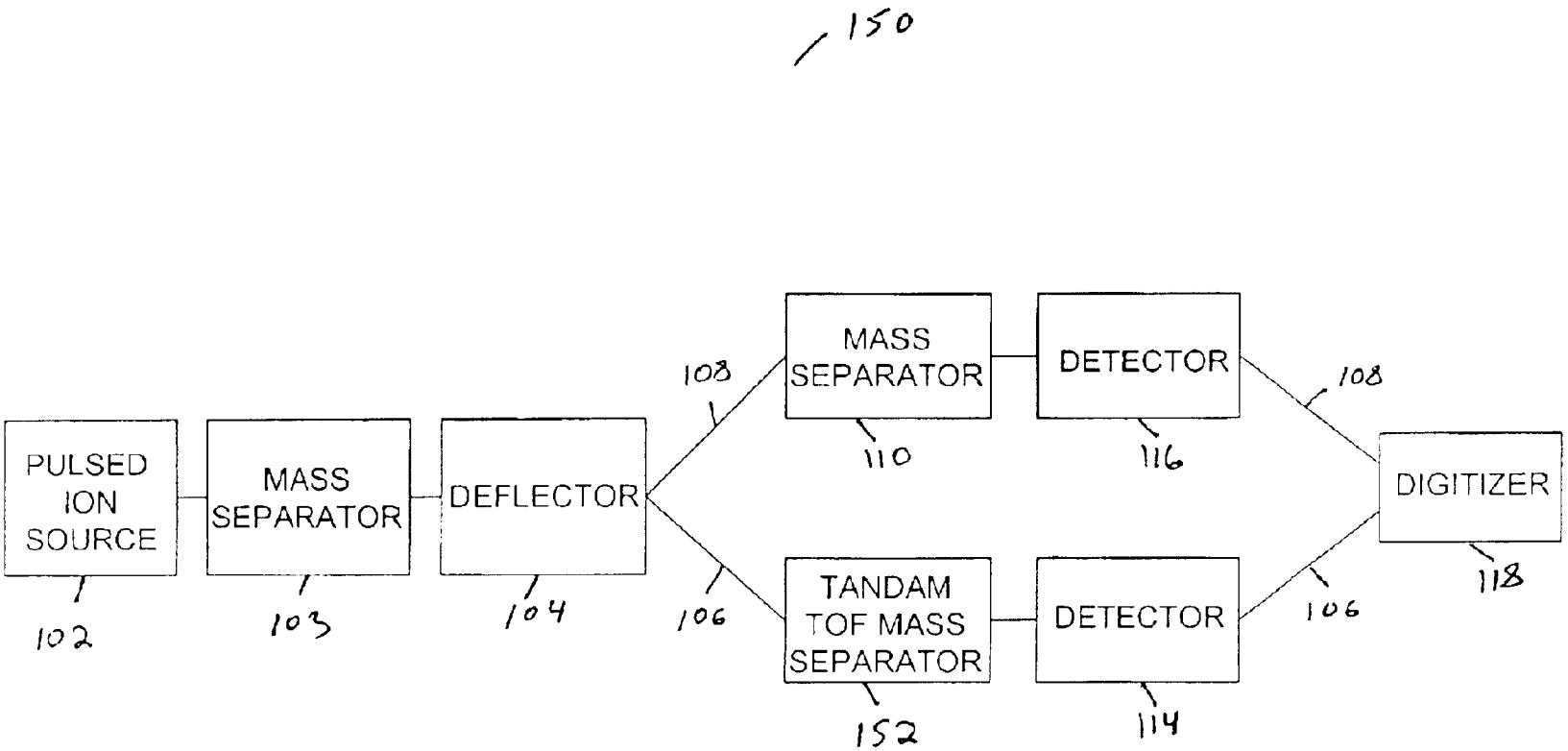
FIG. 4 illustrates a block diagram of an embodiment of a TOF mass analyzer according to the present invention having a mass separator in one flight path and a tandem mass separator in another flight path.

FIG. 4 illustrates a block diagram of an embodiment of a TOF mass analyzer 150 according to the present invention having a mass separator in one flight path and a tandem TOF mass separator in another flight path. One aspect of the TOF mass analyzer 150 of the present invention is that multiple modes of operation can be performed. The TOF mass analyzer 150 can perform multiple modes of operation independently or simultaneously in time.

The TOF mass analyzer 150 is similar to the TOF mass analyzer 100 that was described in connection with FIG. 2. However, the TOF mass analyzer 150 includes a tandem TOF mass separator 152. The TOF mass analyzer 150 includes the pulsed ion source 102 that generates and accelerates the packet of ions as described herein. The accelerated packet of ions then propagates through a mass separator 103 as described herein. The pulsed ion deflector 104 deflects the generated packet of ions into the first ion path 106 and into the second ion path 108 at a predetermined times after ionization.

The tandem TOF mass separator 152 is positioned in the first ion path 106. The tandem TOF mass separator 152 includes multiple mass separators that are positioned in series. The tandem TOF mass separator 152 can include a series combination of any type of mass separator. In one embodiment, the tandem TOF mass separator 152 includes a first and a second mass separator configured in series. For example, the first and second TOF mass separator can include an ion accelerator, an ion selector, and an ion fragmentor. The tandem TOF mass separator 152 is used to determine structural information about samples.

A mass separator 110 is positioned in the second ion path 108. The mass separator 110 can be any type of mass separator as described herein. The first detector 114 is positioned after the tandem TOF mass separator 152 in the first ion path 106. The second detector 116 is positioned after the mass separator 110 in the second ion path 106. The first and second detectors 114, 116 generate electrical pulses at outputs when ions in the packet of ions strike surfaces of the detectors 114, 116. The gain of the first detector 114 can be adjusted independently of the gain of the second detector 116 as described herein.

The first and second detectors 114, 116 have outputs that are electrically connected to a data analyzer or digitizer 118. The digitizer 118 records the electrical pulses produced by the first and the second detectors 114, 116 as a function of time. The time interval between the generation of the packet of ions and the recordation of the electrical pulses produced by the first and second detectors 114, 116 in response to the detected ions is calibrated to provide a measurement of the mass-to-charge ratio of the ion and the fragments thereof. From the measurements of the mass-to-charge ratio of the detected ions and the fragments thereof, structural information about the primary ion can be determined.

The digitizer 118 collects data for ions separated by the first mass separator 110 and the tandem TOF mass separator 152 substantially simultaneously in time. In some embodiments, the TOF mass analyzer 150 includes a processor (not shown) that controls at least one of the pulsed ion source 102, the mass separator 103, the pulsed ion deflector 104, the first mass separator 110, the tandem TOF mass separator 152, and the digitizer 118. The processor can be used to select the mode of operation. The processor can also be used to process data from the digitizer 118 to determine the mass-to-charge ratio of the detected ions and fragments thereof.

The TOF mass analyzer 150 has multiple modes of operation that can be performed sequentially or simultaneously in time. For example, the TOF mass analyzer 150 can simultaneously operate in both the linear MS mode and the MS-MS mode. The linear MS mode can be used for measuring the mass-to-charge ratio of a first ion. The MS-MS mode can be used for measuring the mass-to-charge ratio of a second ion (a precursor ion or a narrow range of precursor ions) and fragments thereof in order to determine the molecular structure of the second ion. The operator can, therefore, determine more information from the TOF mass analyzer 150 for a given time compared with known MS-MS instruments.

A method of operating the TOF mass analyzer 150 in the linear MS mode with MS-MS mode includes generating a packet of ions with the pulsed ion source 102 and accelerating the packet of ions into the mass separator 103 towards the ion deflector 104. The ion deflector 104 propagates a selected first group of ions within a predetermined mass range from the generated packet of ions in the first ion path 106 and deflects the remainder of the packet of ions into the second ion path 108.

The tandem TOF mass separator 152 selects precursor ions (or a narrow range of precursor ions) from the first group of ions and then fragments the precursor ions. The first detector 114 detects as a function of time the precursor ions and fragments thereof. The TOF mass separator 110 separates the remainder of the packet of ions in second ion path 108. The second detector 116 detects as a function of time the mass spectrum of the ions from the second group of ions. The characteristics and position of the first and second detectors 114, 116 may be selected to provide optimum resolution for ions in the first and second group of ions, respectively. The gain of the first and the second detectors 114, 116 can be independently adjusted to optimize the detection of the masses in the two mass ranges.

Both the first and the second detectors 114, 116 can be electrically connected to a single digitizer 118 as described herein assuming that the highest mass ions detected by detector 116 arrives at detector 116 before the lowest mass fragment ion arrives at detector 114. Any possible overlap can be avoided by deflecting high mass ions, which might overlap the fragment spectrum, away from both ion paths 106 and 108.

In one embodiment, the linear MS with MS-MS mode is used to perform isotope-coded affinity tag technology. ICAT™ reagent technology is a mass-spectrometry-based method for separating and analyzing complex samples to identify component proteins and determine relative expression levels. For example, complex protein samples from both normal and diseased sources can be labeled separately and then combined, purified, and analyzed by mass spectrometry. Proteins expressed are compared under different conditions by measuring changes at the individual protein level and identifying the proteins present. ICAT reagent technology can be used to discover targets for therapeutic intervention or markers for diagnostic or toxicity studies.

The TOF mass analyzer 150 can perform the quantitative protein expression and the identification of key proteins simultaneously. The linear MS mode is used to perform quantitative protein expression. The MS-MS mode is used to perform identification of key proteins. In this application, it is necessary to accurately determine the relative intensity of pairs of peaks differing in mass by the mass of the stable isotope label employed, which typically is 8 or 9 Daltons. When applied to complex mixtures of proteins, these spectra often contain a large number of such peak pairs differing in intensity by a factor or 100 or more.

Accurate quantification requires accurately measuring the intensities of theses peaks over a wide dynamic range. It is also necessary to select a number of peaks in the spectrum and obtain an MS-MS spectrum on the fragments to determine the structure of the selected component for identification of the protein from which it is derived. In prior art MS-MS instruments, a single peak, or small mass range is selected, fragmented, and detected, and all ions outside of the selected mass range are discarded.

A TOF mass analyzer according to the present invention can be used to divert the peaks outside the selected mass range to a second mass analyzer and detector, and then record these peaks using the same digitizer that was used to record the MS-MS spectrum. The effective ion flight distances are chosen so that the MS spectrum falls within a different time range than that used for the MS-MS fragment spectrum. The detector characteristics for each spectrum can be independently optimized. Thus, the TOF mass analyzer of the present invention can be used to obtain both a MS-MS spectrum and also a complete MS spectrum except for the portion that was selected for MS-MS.

After completing all of the desired MS-MS measurements, the MS spectra can be summed together to produce a high-quality complete MS spectrum. The measurement precision is proportional to the square-root of the total number of ions recorded in the spectrum. Therefore, detecting essentially all of the ions produced substantially improves the precision of the measurement relative to known mass analyzers where a very large fraction of ions are discarded during MS-MS measurements.

Figure 5:
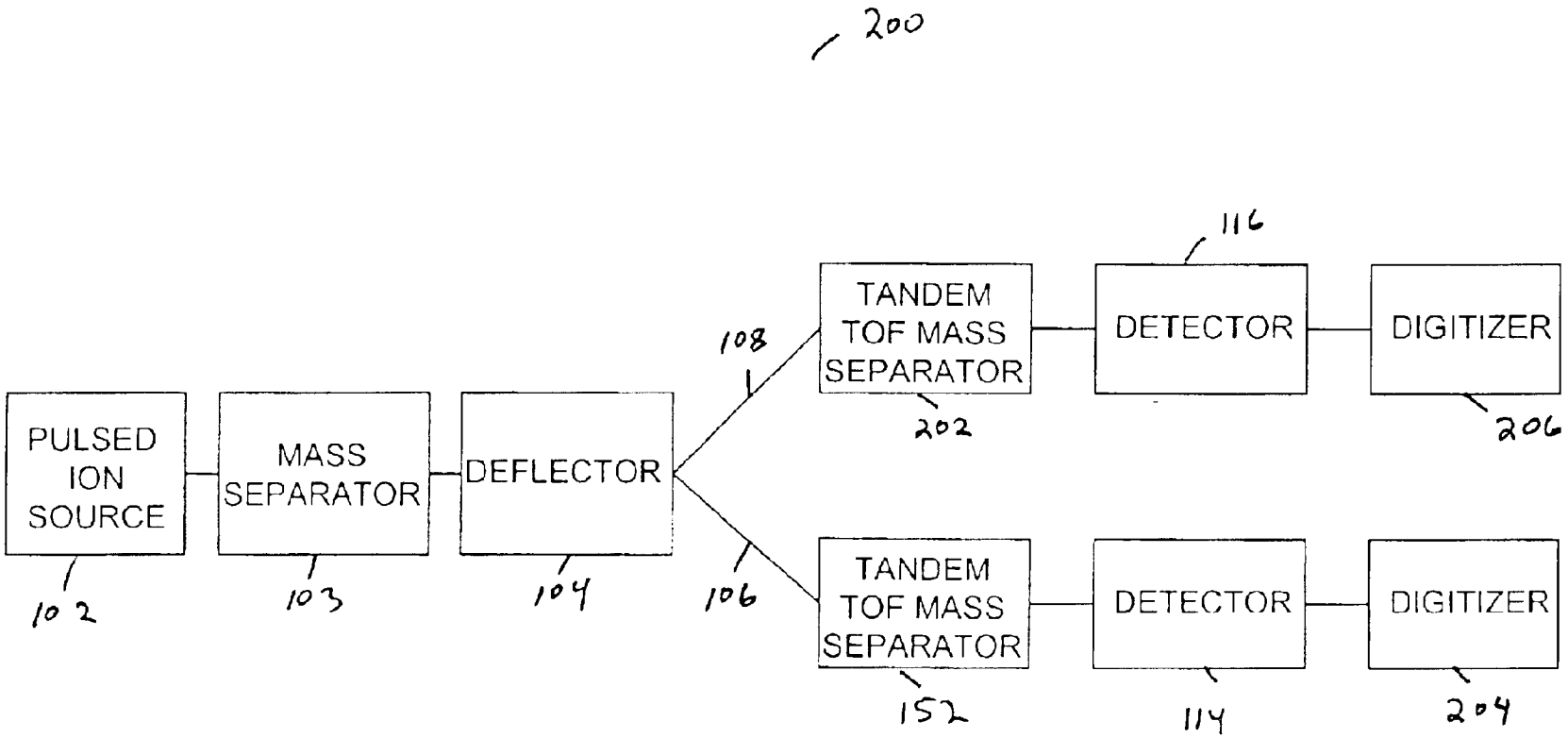
FIG. 5 illustrates a block diagram of a TOF mass analyzer according to the present invention having a first tandem mass separator in one ion path and a second tandem mass separator in another ion path.

FIG. 5 illustrates a block diagram of a TOF mass analyzer 200 according to the present invention having a first tandem mass separator in one ion path and a second tandem mass separator in another ion path. The TOF mass analyzer 200 is similar to the TOF mass analyzer 150 that was described in connection with FIG. 4. However, the TOF mass analyzer 200 includes two tandem TOF mass separators 152, 202.

The TOF mass analyzer 200 includes the pulsed ion source 102 that generates and accelerates the packet of ions. The accelerated packet of ions then propagates through a mass separator 103 as described herein. The ion deflector 104 deflects the packet of ions into the first ion path 106 and the second ion path 108 at a predetermined time intervals after ionization.

The tandem TOF mass separator 152 is positioned in the first ion path 106. A second tandem TOF mass separator 202 is positioned in the second ion path 108. The tandem TOF mass separators 152, 202 can be any type of mass separators that include a series combination of any type of mass separator as described herein. For example, the first and second TOF mass separators 152, 202 can include an ion accelerator, an ion selector, and an ion fragmentor.

The first detector 114 is positioned after the tandem TOF mass separator 152 in the first ion path 106. The second detector 116 is positioned after the second tandem TOF mass separator 202 in the second ion path 108. The first and second detectors 114, 116 generate electrical pulses at outputs when ions strike surfaces of the detectors 114, 116. The gain of the first detector 114 can be adjusted independently of the gain of the second detector 116 as described herein.

The first and the second detectors 114, 116 have outputs that are electrically connected to a first digitizer 204 and a second digitizer 206, respectively. The first digitizer 204 records the electrical pulses produced by the first detector 114 as a function of time. The second digitizer 206 records the electrical pulses produced by the second detector 116 as a function of time. The time interval between the generation of the packet of ions and the recordation of the electrical pulses produced by the first and the second digitizers 204, 206 in response to the detected ions is calibrated to provide a measurement of the mass-to-charge ratio of the detected ions and the fragments thereof.

The first 204 and second digitizer 206 collects data for the mass-to-charge ratio of the detected ions and the fragments thereof for two different types of precursor ions substantially simultaneously in time. Two digitizers may be necessary in this embodiment of the invention because the time ranges for the two fragment spectra can overlap.

In some embodiments, the TOF mass analyzer 200 includes a processor (not shown) that controls at least one of the pulsed ion source 102, the mass separator, the pulsed ion deflector 104, the tandem TOF mass separator 152, the second tandem TOF mass separator 202, and the first 204 and second digitizer 206. The processor can be used to select the mode of operation. The processor can also be used to process data from the first 204 and the second 206 digitizer to determine the mass-to-charge ratio of the precursor ions and fragments thereof and the structural information about the precursor ions.

The TOF mass analyzer 200 has multiple modes of operation that can be performed sequentially or simultaneously in time. In one embodiment, the TOF mass analyzer 200 simultaneously performs MS-MS analysis on two different precursor ions (or narrow range of precursor ions). The TOF mass analyzer 200 operates in the MS-MS mode in the first ion path 106 and the MS-MS mode in the second ion path 108. The simultaneous operation of two MS-MS modes allows the operator to simultaneously determine structural information from two different types of precursor ions. The operator can, therefore, determine more information from the TOF mass analyzer 200 for a given time compared with known MS-MS instruments.

Figure 6:
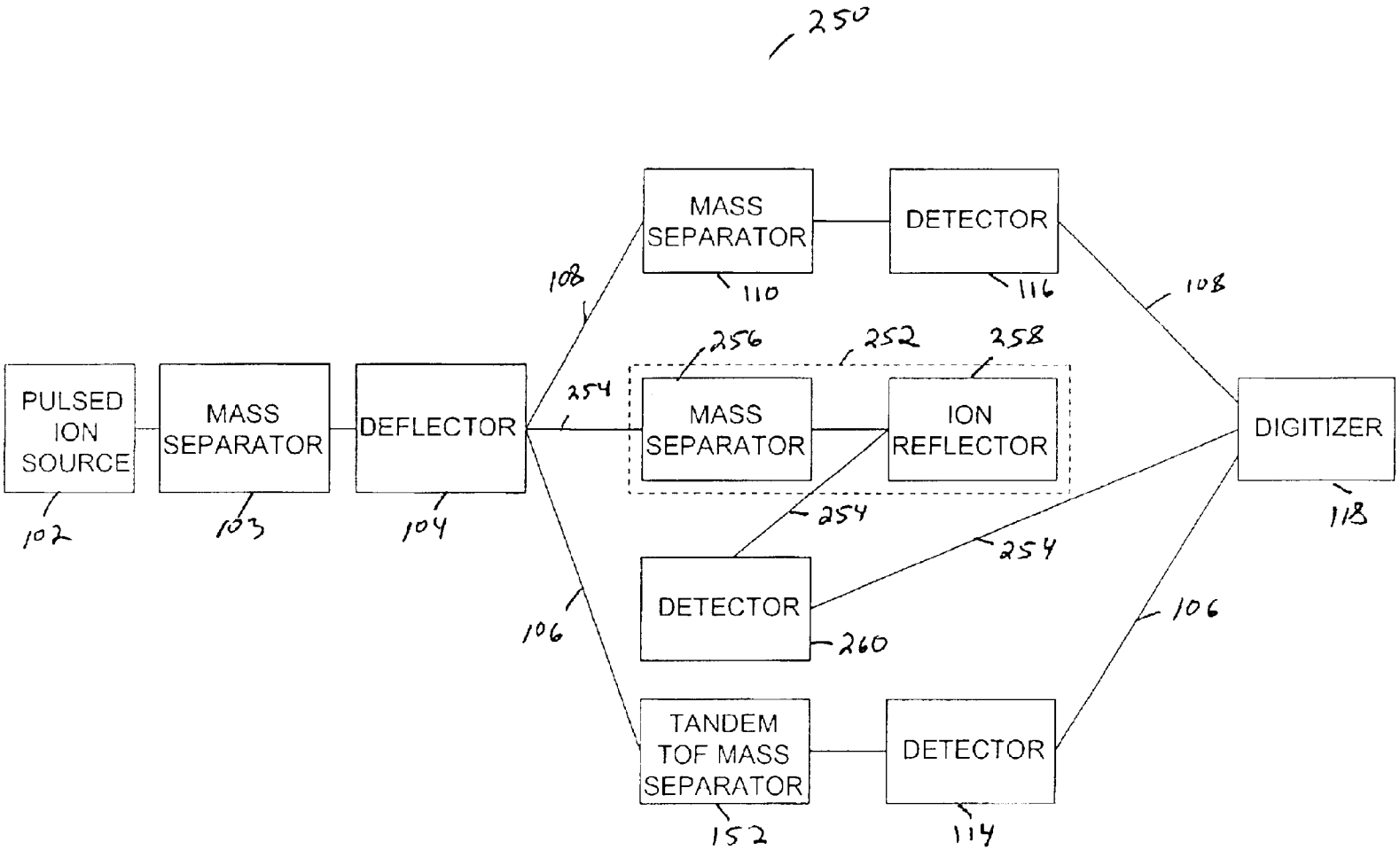
FIG. 6 illustrates a block diagram of a non-linear TOF mass analyzer according to the present invention having a mass separator in a first flight path, a mass separator and an ion reflector in a second flight path, and a tandem mass separator in a third flight path.

FIG. 6 illustrates a block diagram of a non-linear TOF mass analyzer 250 according to the present invention having a mass separator in one ion path, a mass separator and an ion reflector in another ion path, and a tandem mass separator in a third ion path. The non-linear TOF mass analyzer 250 is similar to the TOF mass analyzer 150 of FIG. 3. However, the non-linear TOF mass analyzer 250 includes a non-linear mass analyzer 252 in a third ion path.

The non-linear TOF mass analyzer 250 includes a pulsed ion source 102 that generates the packet of ions. The accelerated packet of ions then propagates through a mass separator 103 as described herein. The pulsed ion deflector 104 deflects the generated packet of ions into the first ion path 106, the second ion path 108, and a third ion path 254 at a predetermined time after ionization. The tandem TOF mass separator 152 is positioned in the first ion path 106. The tandem TOF mass separator 152 includes multiple mass separators in series as described herein. The mass separator 110 is positioned in the second ion path 108. The mass separator 110 can be any mass separator as described herein.

The non-linear mass analyzer 252 is positioned in the third ion path 254 and includes a mass separator 256 this is similar to the mass separators 110, 112 as described herein. The non-linear mass analyzer 252 also includes an ion reflector 258 that is positioned in the third ion path 254 after the mass separator 256. The ion reflector 258 is used for nonlinear operating modes.

The first detector 114 is positioned after the tandem TOF mass separator 152 in the first ion path 106. The second detector 116 is positioned after the mass separator 110 in the second ion path 108. A third detector 260 is positioned after the ion reflector 258 in the third ion path 254. The first, second, and third detectors 114, 116, 260 generate electrical pulses at outputs when ions in the packet of ions strike surfaces of the detectors 114, 116, 260.

The characteristics and position of the first, second, and third detectors 114, 116, and 260 can be selected to provide optimum resolution for the ions and fragments detected. For example, the gains of the first and the second detectors 114, 116 can be independently adjusted to provide optimum resolution for the detected ions and fragments thereof.

The first, second, and third detectors 114, 116, 260 have outputs that are electrically connected to the digitizer 118. The digitizer 118 records the electrical pulses produced by the first, second, and third detectors 114, 116, 260 as a function of time. The time interval between the generation of the packet of ions and the recordation of the electrical pulses produced by the first, second, and third detectors 114, 116, 260 in response to detecting ions, is calibrated to provide a measurement of the mass-to-charge ratio of the ions and the fragments thereof. Structural information about precursor ions can be determined from the measurements of the mass-to-charge ratio of the ions and the fragments thereof.

The digitizer 118 collects data for ions separated by the first mass separator 110, the tandem TOF mass separator 152, and the non-linear mass analyzer 252 substantially simultaneously in time. The first, second, and third detectors 114, 116, and 260 can be connected to a single digitizer 118 as described herein assuming that the highest mass ions strike one of the detectors before the lowest mass fragment ion as described herein. In one embodiment, the distances of the ion paths 106, 108, and 254 are adjusted to avoid spectral overlap of the high and low mass ions. In one embodiment, the deflector 104 is energized to prevent ions above some predetermined mass from reaching the third detector 260 to avoid overlapping the mass spectrum detected by the first and second detectors 114, 116.

In some embodiments, the TOF mass analyzer 250 includes a processor (not shown) that controls at least one of the pulsed ion source 102, the mass separator 103, the pulsed ion deflector 104, the first mass separator 110, the tandem TOF mass separator 152, the non-linear mass analyzer 252, and the digitizer 118. The processor can be used to select the mode of operation. The processor can also be used to process data from the digitizer 118 to determine the mass-to-charge ratio of detected ions and fragments thereof and to determine structural information of precursor ions.

The non-linear TOF mass analyzer 250 has multiple modes of operation that can be performed sequentially or simultaneously in time. The non-linear TOF mass analyzer 250 can perform three modes of operation simultaneously. The ability to simultaneously perform three operating modes can significantly increase the throughput and efficiency of the instrument. In known tandem MS-MS instruments, only one of the three operating modes can be performed at any given time.

In one embodiment, the TOF mass analyzer 250 operates simultaneously in the linear MS mode, the MS-MS mode and the non-linear MS mode. For example, the linear MS mode can be used for measuring one type of ion. The MS-MS mode can be used for measuring both a precursor ion (or a narrow range of precursor ions) and fragments thereof of another type of ion in order to determination molecular structure. The non-linear MS mode can be used for high-resolution mass analysis of a third type ion.

A method of operating the non-linear TOF mass analyzer 250 in the linear MS, MS-MS, and non-linear MS modes includes generating a packet of ions with the pulsed ion source 102 and accelerating the packet of ions towards the pulsed ion deflector 104. The pulsed ion deflector 104 deflects the generated packet of ions into the first, second, and third ion paths 106, 108, and 254 at a predetermined time after ionization.

The tandem TOF mass separator 152 separates the precursor ions in a first group of ions and then fragments the precursor ions. The first detector 114 detects as a function of time the precursor ions and fragments thereof. The TOF mass separator 110 separates ions in a second group of ions. The second detector 116 detects the mass spectrum of the ions in the second group of ions as a function of time.

The mass separator 256 in the non-linear mass analyzer 252 separates ions in a third group of ions. The separated ions in the third group of ions pass the mass separator 256 and penetrate into the ion reflector 258. The separated ions in the third group of ions are then decelerated until the velocity component in the direction of the electric field generated by the ion reflector 258 becomes zero. Then the separated ions in the third group of ions reverse direction and are accelerated back through the ion reflector 258. The separated ions in the third group of ions exit the ion reflector 258 with energies that are substantially identical to their incoming energy but with velocities that are in the opposite direction.

For example, ions with larger energies penetrate more deeply and, consequently, will remain in the ion reflector 258 for a longer period of time. In a properly designed ion reflector, the potentials are selected to modify the flight paths of the ions such that ions of like mass and charge arrive at the third detector 260 at the same time regardless of their initial energy. Thus, the non-linear mass analyzer 252 provides relatively high mass resolution. In one embodiment, the non-linear mass analyzer 252 is used to detect low mass ions. The focal length of the ion reflector 258 is adjusted to focus lower masses onto the third detector 260.

There are many applications for the TOF mass analyzer of the present invention. For example, one application for the TOF mass analyzer of the present invention is to determine the molecular weight of peptides and intact proteins that have a broad mass range. For example, the TOF mass analyzer of the present invention can simultaneously determine the accurate molecular weight of small peptides and intact proteins ranging in mass from a few hundred Daltons to several hundred thousand Daltons. Known TOF mass analyzers require several separate measurements over a series of mass ranges to achieve comparable accuracy and sensitivity.

It is difficult for known mass analyzers to make such measurements over a wide mass range and dynamic range. Ions derived from the MALDI matrix typically have a mass that is below 1 kilo Dalton. The abundance of these ions can be very high relative to the abundance of the protein ions of interest. If these low mass ions strike the detector, they can saturate the detector and reduce its capability to detect the higher mass ions of interest. One known technique is to use a pulsed deflector to direct the low mass ions away from the flight path, so that only the high mass ions are detected. However, if this is done, any information associated with the low mass portion is lost, and these ions are not measured.

A TOF mass analyzer according to the present invention is able to detect these low mass ions with a second detector. The parameters of the second detector, such as the position and the gain of the detector can be independently adjusted to optimize the performance of the second detector for detecting the low mass portion of the spectrum. A single digitizer can be used for both the first and the second detector so long as the time range utilized by the second detector does not overlap with the time range used by the first detector.

In some applications of the present invention, the low mass ions are not of particular interest since they are produced from a MALDI matrix that is well characterized. However, the spectra of both low mass and high mass ions are recorded for each laser pulse simultaneously so that any uncontrolled variation if voltages or distances, for example due to temperature changes, are the same for both sets of ions. Since the masses of the low mass matrix ions are known, the peaks corresponding to known matrix ions can be used to correct the mass calibration of the high mass ions.

The TOF mass analyzer according to the present invention can obtain a high-resolution spectrum of low mass ions using a TOF mass analyzer equipped with an ion reflector. The TOF mass analyzer according to the present invention can also obtain a low-resolution spectrum of high mass ions using a linear TOF mass analyzer comprising a field-free drift space and a detector.

Known mass analyzers use a single ion path between the ion source and ion mirror and are not well suited for these applications. In these known analyzers, the linear detector is located along the ion path behind the ion mirror. A high mass spectrum is obtained on the linear detector by deactivating the mirror voltage to allow ions to pass through to the linear detector. In principal, the mirror voltage could be turned off at some time during the flight time of each pulse of ions. However, in practice, such a procedure is not practical for several reasons. One reason is that a large fraction of the total mass range is within the mirror at any selected time. If the mirror is turned off, these ions would only contribute noise to both spectra. Furthermore, the ion source focusing conditions are different for the linear detector and for the reflector. Thus, two separate measurements are required.

Yet another application for the TOF mass analyzer according to the present invention is to accurately determine the intensity of a large number of peaks in a mass spectrum and then to fragment selected peaks in the spectrum to obtain an MS-MS spectrum on the fragments in order to determine the structure of a selected component. Known mass analyzers select a single peak, or small mass range and then fragment and detect the selected ions. All ions outside of the selected mass range are discarded.

The TOF mass analyzer according to the present invention diverts ions outside the selected mass range to a second mass analyzer and detector and then to a digitizer, which can be the same digitizer as the digitizer used for the MS-MS spectrum. The effective ion flight distances are chosen so that the MS spectrum falls within a different time range than the time range employed for the MS-MS fragment spectrum. The detector characteristics for each spectrum can be independently optimized. Thus, each MS-MS spectrum also contains a complete MS spectrum except for the portion that was selected for MS-MS analysis.

After completing all of the desired MS-MS measurements, the MS spectra can be summed together to produce a high-quality complete MS spectrum. The precision of measurement is proportional to the square-root of the total number of ions recorded in the spectrum. Therefore, detecting essentially all of the ions produced substantially improves the precision of the measurement relative to known mass analyzers in which a very large fraction of ions are discarded during MS-MS measurements.

Equivalents

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A TOF mass analyzer having multiple flight paths, the TOF mass analyzer comprising:

a) a pulsed ion source that generates a packet of ions and that accelerates the packet of ions;

b) an ion deflector that receives the packet of ions and directs a first group of ions from the packet of ions to a first ion path for a first predetermined time interval after the pulsed ion source generates the packet of ions and that directs a second group of ions from the packet of ions to a second ion path for a second predetermined time interval after the pulsed ion source generates the packet of ions;

c) a first TOF mass separator positioned to receive the first group of ions propagating along the first ion path, the first TOF mass separator separating the first group of ions according to their mass to-charge ratio;

d) a first detector positioned to receive the first group of ions that are propagating along the first ion path after being separated by the first TOF mass separator;

e) a second TOF mass separator positioned to receive the second group of ions propagating along the second ion path, the second TOF mass separator separating a second group of ions according to their according to their mass to-charge ratio; and f) a second detector positioned to receive the second group of ions that are propagating along the second ion path after being separated by the second TOF mass separator.

2. The TOF mass analyzer of claim 1 wherein the pulsed ion source comprises a laser desorption/ionization ion source.

3. The TOF mass analyzer of claim 1 wherein the pulsed ion source comprises a delayed extraction ion source.

4. The TOF mass analyzer of claim 1 wherein the pulsed ion source comprises an injector that injects ions into a first field-free region and a pulsed ion accelerator that extracts the ions in a direction that is orthogonal to a direction of injection.

5. The TOF mass analyzer of claim 1 wherein at least one of the first and the second TOF mass separators comprises a field-free drift region.

6. The TOF mass analyzer of claim 1 further comprising a mass separator between the pulsed ion source and the ion deflector.

7. The TOF mass analyzer of claim 6 wherein the mass separator comprises a field free region.

8. The TOF mass analyzer of claim 1 wherein at least one of the first and the second TOF mass separators comprises an ion fragmentor that fragments a portion of the ions propagating in the at least one of the first and the second TOF mass separators.

9. The TOF mass analyzer of claim 1 wherein at least one of the first and the second TOF mass separators comprises a timed ion selector.

10. The TOF mass analyzer of claim 1 further comprising an ion reflector that is positioned to receive the first group of ions.

11. The TOF mass analyzer of claim 1 further comprising an ion reflector that is positioned to receive the second group of ions.

12. The TOF mass analyzer of claim 1 further comprising a first and a second data analyzer that are electrically connected to the first and the second detectors, respectively.

13. The TOF mass analyzer of claim 1 further comprising a data analyzer that is electrically connected to both the first and the second detectors.

14. The TOF mass analyzer of claim 12 wherein the data analyzer is a digitizer receiving an electrical signal generated either by a single pulse or from multiple pulses of the same sample that are summed to produce an average mass spectrum.

15. The TOF mass analyzer of claim 13 wherein the data analyzer is a digitizer receiving an electrical signal generated either by a single pulse or from multiple pulses of the same sample that are summed to produce an average mass spectrum.

16. The TOF mass analyzer of claim 1 further comprising a processor that instructs the ion deflector to direct the first group of ions to propagate along the first ion path for a first predetermined time interval after the pulsed ion source generates the packet of ions and a second group of ions to propagate along the second ion path for a second predetermined time interval after the pulsed ion source generates the packet of ions.

17. The TOF mass analyzer of claim 1 further comprising a processor that instructs a data analyzer to record electrical signals generated by at least one of the first and the second detectors, the processor determining a mass-to-charge ratio of ions generated by the pulse ion source.

18. A method for TOF mass spectrometry, the method comprising:

a) generating and accelerating a packet of ions from a sample of interest;

b) deflecting a first group of ions from the packet of ions to a first ion path at a first predetermined time after generating the packet of ions;

c) separating the first group of ions according the their mass-to-charge ratios;

d) detecting the first group of ions;

e) deflecting a second group of ions from the packet of ions to a second ion path at a second predetermined time after generating the packet of ions;

f) separating the second group of ions according to their mass-to-charge ratios; and g) detecting the second group of ions.

19. The method of claim 18 wherein the time range for detecting the first group of ions does not overlap with the time range for detecting the second group of ions.

20. The method of claim 18 wherein detecting the first group of ions comprises digitizing data corresponding to the first group of ions.

21. The method of claim 18 wherein detecting the second group of ions comprises digitizing data corresponding to the second group of ions.

22. The method of claim 18 wherein the first group of ions comprises relatively low mass ions and the second group of ions comprises relatively high mass ions.

23. The method of claim 18 wherein generating the packet of ions comprises performing laser desorption/ionization.

24. The method of claim 18 wherein generating and accelerating the packet of ions comprises injecting ions into a field-free region and accelerating the ions in a direction that is orthogonal to a direction of injection.

25. The method of claim 18 wherein separating the first group of ions comprises drifting the first group of ions through a field-free drift space.

26. The method of claim 18 wherein separating the second group of ions comprises drifting the second group of ions through a field-free drift space.

27. The method of claim 18 including the step of fragmenting the first group of ions.

28. The method of claim 18 including the step of fragmenting the second group of ions.

29. The method of claim 18 wherein separating the first group of ions comprises selecting ions within a predetermined time interval.

30. The method of claim 18 wherein separating the second group of ions comprises selecting ions within a predetermined time interval.

31. The method of claim 18 wherein the packet of ions comprises a single pulse of ions.

32. The method of claim 20 wherein digitizing data comprises receiving an electrical signal generated by either a single pulse or from multiple pulses of the same sample that are summed to produce an average mass spectrum.

33. The method of claim 21 wherein digitizing data comprises receiving an electrical signal generated by either a single pulse or from multiple pulses of the same sample that are summed to produce an average mass spectrum.

34. A TOF mass analyzer having multiple flight paths, the TOF mass analyzer comprising:

a) a pulsed ion source that generates a packet of ions and that accelerates the packet of ions;

b) an ion deflector that receives the packet of ions and directs a first group of ions from the packet of ions to a first ion path for a first predetermined time interval after the pulsed ion source generates the packet of ions, that directs a second group of ions from the packet of ions to a second ion path for a second predetermined time interval after the pulsed ion source generates the packet of ions, and that directs a third group of ions from the packet of ions to a third ion path for a second predetermined time interval after the pulsed ion source generates the packet of ions;

c) a first TOF mass separator positioned to receive the first group of ions propagating along the first ion path, the first TOF mass separator separating the first group of ions according to their mass to-charge ratios;

d) a first detector positioned to receive the first group of ions that are propagating along the first ion path after being separated by the first TOF mass separator;

e) a second TOF mass separator positioned to receive the second group of ions propagating along the second ion path, the second TOF mass separator separating a second group of ions according to their according to their mass to-charge ratios;

f) a second detector positioned to receive the second group of ions that are propagating along the second ion path after being separated by the second TOF mass separator; and g) a third TOF mass separator positioned to receive the third group of ions propagating along the third ion path, the third TOF mass separator separating a third group of ions according to their according to their mass to-charge ratios.

35. The TOF mass analyzer of claim 34 further comprising a third detector positioned to receive the third group of ions that are propagating along the third ion path.

36. A TOF mass spectrometer comprising:

a) means for generating and accelerating a packet of ions;

b) means for directing a first group of ions from the packet of ions to a first ion path for a first predetermined time interval after generating the packet of ions;

c) means for separating the first group of ions;

d) means for detecting the first group of ions after being separated by the first separating means;

e) means for directing a second group of ions from the packet of ions to a second ion path for a second predetermined time after generating the packet of ions;

f) means for separating the second group of ions; and g) means for detecting the second group of ions after being separated by the second separating means.

* * * * *